US010029170B1

(12) United States Patent
Miller

(10) Patent No.: US 10,029,170 B1
(45) Date of Patent: Jul. 24, 2018

(54) POKER GAME

(71) Applicant: John P. Miller, Seattle, WA (US)

(72) Inventor: John P. Miller, Seattle, WA (US)

( * ) Notice: Subject to any disclaimer, the term of this patent is extended or adjusted under 35 U.S.C. 154(b) by 0 days.

(21) Appl. No.: 15/269,274

(22) Filed: Sep. 19, 2016

Related U.S. Application Data

(60) Provisional application No. 62/232,630, filed on Sep. 25, 2015.

(51) Int. Cl.

| | |
|---|---|
| ***A63F 1/00*** | (2006.01) |
| ***G07F 17/32*** | (2006.01) |
| *A63F 3/00* | (2006.01) |
| *A63F 1/06* | (2006.01) |

(52) U.S. Cl.
CPC ..... *A63F 1/00* (2013.01); *G07F 17/322* (2013.01); *G07F 17/3211* (2013.01); *G07F 17/3258* (2013.01); *G07F 17/3293* (2013.01); *A63F 1/067* (2013.01); *A63F 3/00157* (2013.01); *A63F 2001/005* (2013.01); *A63F 2003/00164* (2013.01); *A63F 2003/00167* (2013.01)

(58) Field of Classification Search
CPC ..... A63F 2001/005; A63F 1/067; A63F 2003/00164; A63F 2003/00167; A63F 3/00157
USPC ..... 273/292, 274, 309; 463/13, 26, 25, 27
See application file for complete search history.

(56) References Cited

U.S. PATENT DOCUMENTS

| | | | |
|---|---|---|---|
| 4,836,553 | A | 6/1989 | Suttle et al. |
| 5,100,137 | A | 3/1992 | Fulton |
| 5,167,413 | A | 12/1992 | Fulton |
| 5,242,163 | A | 9/1993 | Fulton |
| 5,251,897 | A | 10/1993 | Fulton |
| 5,288,081 | A | 2/1994 | Breeding |
| 5,322,295 | A | 6/1994 | Cabot et al. |
| 5,411,257 | A | 5/1995 | Fulton |
| 5,437,451 | A | 8/1995 | Fulton |
| 5,489,101 | A | 2/1996 | Moody |
| 5,531,448 | A | 7/1996 | Moody |
| 5,657,993 | A | 9/1997 | Merlino et al. |
| 5,685,774 | A | 11/1997 | Webb |
| 5,711,525 | A | 1/1998 | Breeding |
| 5,752,702 | A | 5/1998 | McDoniel |
| 5,820,460 | A | 10/1998 | Fulton |
| 5,839,732 | A | 11/1998 | Guidi |
| 5,901,958 | A | 5/1999 | Andrews |

(Continued)

OTHER PUBLICATIONS

"Five-card-stud" entry on wikipedia.org; available as of Mar. 25, 2015.

*Primary Examiner* — Benjamin Layno

(74) *Attorney, Agent, or Firm* — Warner Norcross + Judd LLP

(57) ABSTRACT

A casino table poker game where all cards are dealt face-up and the dealer plays a hand. Players each place an ante wager and are initially dealt a partial face-up poker hand and the dealer is dealt a complete face-up poker hand. If the dealer's poker hand meets or exceeds a kick out threshold, the dealer folds her poker hand. The kick out threshold can vary based on the number of players in the game. Then, from lowest to highest rank of partial face-up poker hands, players can fold or pay an additional wager to receive additional cards to complete their face-up poker hand. The pot is awarded to the dealer or player with the best poker hand according to a predetermined set of poker game rules.

19 Claims, 3 Drawing Sheets

(56) References Cited

U.S. PATENT DOCUMENTS

| | | | | |
|---|---|---|---|---|
| 5,928,081 | A | 7/1999 | Bochichio et al. | |
| 5,975,529 | A | 11/1999 | de Keller | |
| 5,988,643 | A | 11/1999 | Awada | |
| 6,042,118 | A | 3/2000 | Poitra | |
| 6,206,780 | B1 | 3/2001 | Awada | |
| 6,273,424 | B1 | 8/2001 | Breeding | |
| 6,651,981 | B2 | 11/2003 | Grauzer et al. | |
| 6,705,943 | B2 | 3/2004 | Awada | |
| 6,986,514 | B2 | 1/2006 | Snow | |
| 7,175,522 | B2 | 2/2007 | Hartl | |
| 7,246,799 | B2 | 7/2007 | Snow | |
| 7,264,243 | B2 | 9/2007 | Yoseloff et al. | |
| 7,661,676 | B2 | 2/2010 | Smith et al. | |
| 8,851,478 | B2 | 10/2014 | Moody | |
| 9,114,310 | B1 | 8/2015 | Poisson | |
| 2002/0042298 | A1* | 4/2002 | Soltys | G06Q 10/0639 463/29 |
| 2002/0195773 | A1* | 12/2002 | Dunn | A63F 3/00006 273/243 |
| 2004/0041346 | A1* | 3/2004 | Snow | A63F 1/00 273/292 |
| 2005/0148391 | A1* | 7/2005 | Tain | A63F 1/14 463/42 |
| 2005/0164762 | A1 | 7/2005 | Smith et al. | |
| 2005/0242506 | A1 | 11/2005 | Yoseloff | |
| 2008/0274783 | A1* | 11/2008 | Walker | G07F 17/32 463/13 |
| 2009/0270151 | A1 | 10/2009 | Moody | |
| 2009/0270152 | A1 | 10/2009 | Moody | |
| 2009/0278315 | A1 | 11/2009 | Sklansky et al. | |
| 2012/0225706 | A1 | 9/2012 | Yoseloff | |
| 2014/0120997 | A1 | 5/2014 | Colacone | |

* cited by examiner

POKER GAME

BACKGROUND OF THE INVENTION

The present invention relates to the field of games, card games, wagering card games, and specifically poker-type casino wagering games.

Poker style games are well known and have been popular for years. Poker has a low barrier to entry—a deck of playing cards, a few participants, and a playing surface. In most poker games, players generally wager based on a predetermined set of poker game rules, for example that they will have the highest poker hand ranking at the end of the game. Players are typically dealt a hand of poker cards during the game from a randomized standard poker deck of playing cards. Depending on the specific flavor of poker, the betting and play structure can vary. For example, the timing and amount of wagers can vary; the timing of when cards are dealt and where they are dealt can also vary, to name a few ways in which poker games can vary. One popular poker game that many people know how to play is Five Card Poker. Five Card Poker uses the same basic ranking of winning poker hands as most poker games: royal flush, straight flush, four of a kind, full house, flush, straight, three of a kind, two pair, one pair and high card(s) in hand.

Most casino poker games are spread in a poker room where the casino provides a dealer, playing cards, table and chairs, but the casino does not play a hand. Instead, the casino collects a percentage of the pot, referred to as the rake. Alternatively, some casinos charge an hourly fee, referred to as a seat charge. Although this style of poker environment has been successful for casinos, casinos would like the ability to spread a poker game in the casino pit where the dealer plays in the game. For a variety of reasons, casino table game variants have not been successful in adapting the rules of poker into a casino table game. Perhaps most notably, known casino table poker games are played heads-up, player versus dealer. Although this style of play has been somewhat successful, it ultimately fails to bring a meaningful poker experience to the casino pit.

SUMMARY OF THE INVENTION

The present invention relates to a casino table poker game where all cards are dealt face-up and the dealer plays a hand. The dealer and players each place an ante wager, each player is dealt a partial face-up poker hand, and the dealer is dealt a complete face-up poker hand. The ante wagers are collected into a common pot for which the dealer and players compete. If the dealer's poker hand qualifies for a kick out by meeting or exceeding a kick out predetermined poker hand rank threshold, then the dealer folds and depending on whether or not the game is being played with a kickback, adds a kickback to the pot. The kick out predetermined poker hand rank threshold may be referred to as simply a kick out threshold or kick out limit. Then, in order from lowest to highest rank of partial face-up poker hands, players can fold or pay an additional wager to receive additional cards to complete their face-up poker hand. Once all the players have acted or if one of the poker hands at the table cannot be beaten, then the pot, including all of the ante wagers, additional wagers, and any kickback, is awarded to the dealer or player with the best poker hand according to a predetermined set of poker game rules.

In one embodiment with a kickback, the amount of the kickback matches the wagers in the pot, thereby doubling the size of the pot. In some embodiments, the amount of the kickback is different, for example the amount of the kickback may vary not only based on the size of the pot, but also based on the strength of the dealer's hand. Further, the predetermined poker hand rank threshold for determining whether the dealer's hand qualifies for a kick out can vary based on the number of players in the game. For example, the kick out threshold can vary depending on the number of ante wagers placed in the game.

The players' ante wagers are equal in size so that the players contribute equally to the common pot and competition is fair. To facilitate variable size wagers, the game can provide a side bet on the strength of the dealer's hand contingent on the player placing an ante wager. The amount of the side bet on the strength of the dealer's hand can vary, but may be limited by table limits. In this embodiment, at the outset when the players are anteing they may also place a side bet on the strength of the dealer's poker hand. After the dealer's full poker hand has been dealt, the dealer collects or pays the side bets based on a predetermined pay table. It is worth noting that side bets are not in the pot, and are not a factor in determining the size of the pot or the size of the kickback.

Dealing all cards face-up makes the game transparent, manageable for the dealer, and easier to understand for the players. Further, because all cards are dealt face-up for all players to see, players have more information on which to base their strategic decisions than in a conventional poker game where opponents have hidden information. In addition, because all cards are dealt face-up there is no bluffing. Bluffing is an aspect of poker that can deter some players from playing, especially in a casino setting. Accordingly, dealing cards face-up gives players more information to apply pot odds and basic poker strategy to play the game strategically, without having to worry about bluffing or being bluffed by their opponents. Even with the additional information that face-up cards provide and the elimination of bluffing, playing perfectly is a significant challenge.

By having the initial partial poker hands face-up, play can be organized by the rank of the face-up initial partial poker hands, which has several benefits. Organizing the order of player action by rank of partial poker hands randomizes the player order in an equitable way and removes advantage that might be conveyed by a player's position at the table. Further, forcing players to act in order of worse partial starting hands to best partial starting hands increases the frequency of lead changes in the game, which can increase excitement. Generally, acting later in turn order is an advantage because the decision of whether to fold or place an additional bet can be based on additional information provided by players earlier in the turn order folding or taking additional face-up cards.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT EMBODIMENTS

Figure 1:
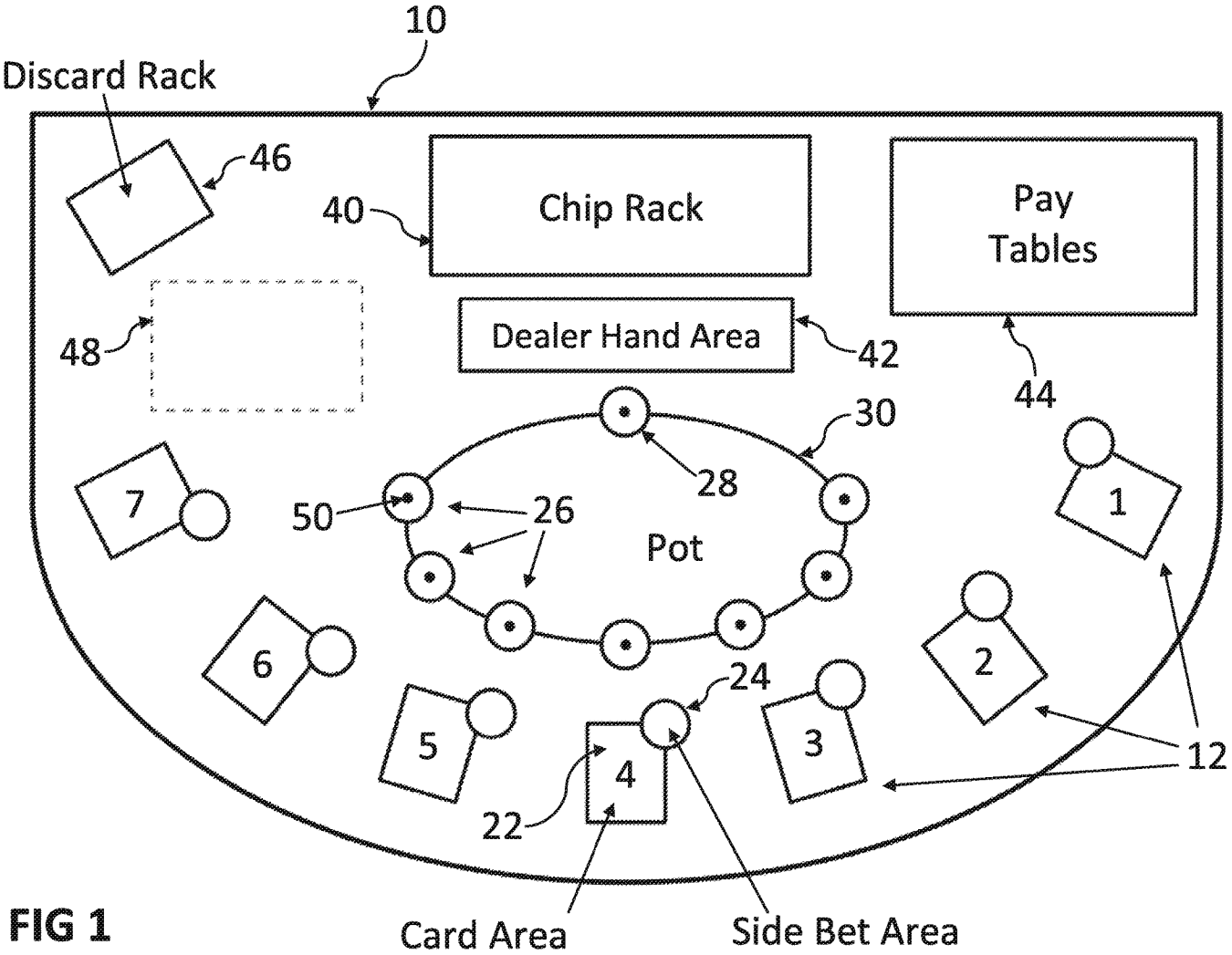
FIG. 1 shows a table layout for a game according to one embodiment.

FIG. 1 illustrates one embodiment of an apparatus for the wagering game of the present invention. The apparatus includes a casino gambling or gaming table 10. The table includes a curved side for accommodating up to seven players and a straight side for accommodating a dealer. The table 10 has a surface covered with felt or other appropriate material. Although seven playing positions are illustrated, additional or fewer playing positions can be provided in alternative embodiments. One player can play against the dealer. Further, one player can play multiple hands, similar to Blackjack, by making multiple ante wagers at different player positions.

The illustrated table layout includes seven player positions 12. Each player position 12 has a card area 22 and a side bet area 24. The table layout 10 also includes a pot area 30 with edge marks 26, 28. The edge marks include player edge marks 26 and a dealer edge mark 28. Chips on the player edge mark spots 26 indicate that a player is in the game. When a player places a second bet, it can be placed beside the original bet at the player's respective edge mark. The dealer can place her ante bet on the dealer edge mark spot 28. These edge mark spots make it clear which bets are in the pot, without losing the ability to track the origin of the bet. Put another way, the edge marks facilitate ease of observation for the players, the dealer, and other casino staff.

The table layout may include a posting with the rules of the game, payout tables, and a kick out threshold indicator 44 displayed near or on the table 10. The kick out threshold indicator indicates the kick out threshold for the current number of hands in the game. The kick out threshold indicator can be posted using poker cards so that the players can compare the kick out threshold hand on the indicator to the actual dealer cards.

Some embodiments of the wagering game may be electronically assisted. For example, in one embodiment, an electronic display 48 and chip sensors 50 may optionally be provided. The display can show the current kick out threshold based on the number of players using sensor data to determine the number of players in the game. The sensor data can also be used to automatically update the electronic display 48 as the number of players changes from game to game. It should be understood that the number of players in the game may be determined by counting the number of hands in the game or the number of ante wagers in the game. If one player is playing multiple player positions by placing multiple ante wagers, each being dealt a separate hand, each hand or ante would be counted to determine the number of players used for the kick out threshold determination.

In the depicted embodiment, each chip sensor 50 can provide sensor data indicative of whether an ante wager is present on a respective player edge mark spot 26. This sensor data can be used to determine how many players are in the game, which can be used to display the appropriate kick out hand threshold on the electronic display 48. The chip sensors 50 can be optical sensors, weight sensors, or any other type of sensor that can provide sensor data indicative of whether an ante wager is present. Although not precluded, the chip sensors 50 need not be capable of ascertaining whether a second bet has been placed.

The table layout can also include a chip rack 40 and a dealer hand area 42 where the dealer's hand is displayed. A discard rack 46 may also be provided.

Figure 3:
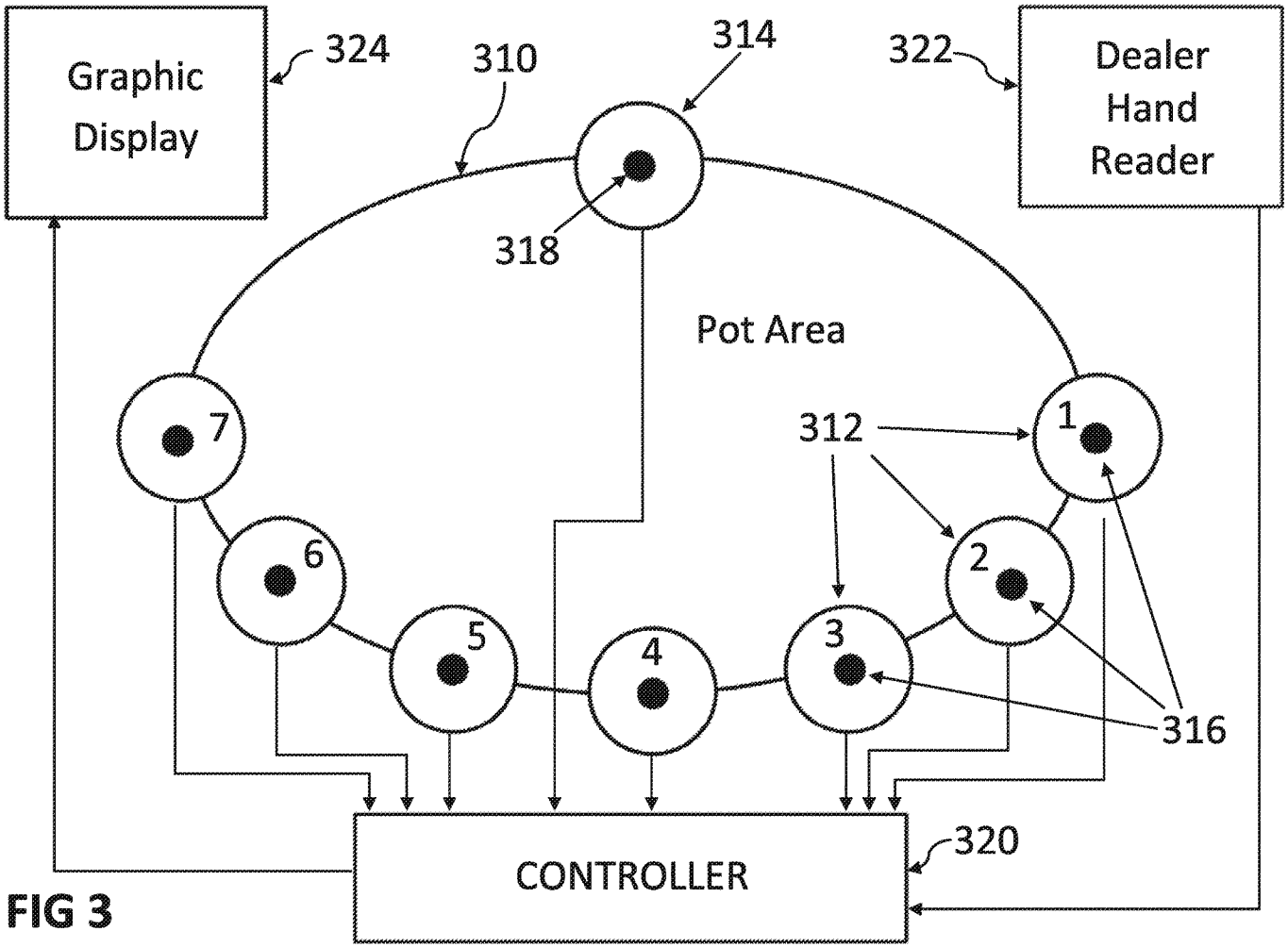
FIG. 3 shows a representative diagram of one embodiment of an electronically assisted wagering game.

FIG. 3 illustrates a representative diagram showing the electrical connections for one embodiment of an electronically assisted wagering game. The pot area 310 is illustrated with the player edge marks 312 where the players' bets are moved to during the deal by the dealer. The pot area 310 also includes a dealer edge mark where the dealer's ante bet is placed. The player chip sensors 316 detect whether a player is in the hand, thus counting the number of players. The dealer chip sensor 318 detects that the dealer is in the hand, which can communicate to a controller 320 to provide permission for the controller to display the correct kick out hand on the graphic display 324.

A controller 320 can be provided for electronically assisting with the wagering game. The controller 320 can be a microcontroller, computer processor, or other calculating device. The controller can be integrated or separate from the graphic display 324. Further, the controller 320 may include memory or be in communication with external memory. The controller 320 can be coupled to the player chip sensors 316, the dealer chip sensor 318, and the graphic display 324. The controller can receive sensor data from the player chip sensors 316, compare the sensor data to a kick out threshold table stored in memory, determine the appropriate threshold hand, and in response to the dealer chip sensor data indicating the dealer has placed her ante wager, communicate with the graphic display to display the appropriate threshold hand. The controller 320 can continuously and dynamically update the appropriate threshold hand until the controller receives dealer sensor data indicating that the dealer's chip is in place at which point the controller 320 can change the graphic display.

In one embodiment, a dealer hand reader 322 is coupled to a controller 320. A dealer hand reader is a device that can read the dealer's hand and convey that information to the controller. For example, the dealer hand reader can include a camera or other image capturing device. The dealer hand reader can be configured to engage in response to the dealer's edge mark 314 being occupied by a chip.

In embodiments with a dealer hand reader, the controller 320 can use dealer hand reader data to determine whether the dealer's hand qualifies for the kick out threshold by comparing the dealer hand reader data to the determined kick out threshold. In this embodiment, the controller can display not only the kick out threshold, but also if and when the dealer's hand qualifies for that kick out threshold.

The graphic display 324 can be configured to display the rank of the kick out hand as determined by the number of players, and display whether or not the hand pays as determined by the dealer hand (via the dealer hand reader). When not active, the graphic display 324 can also display other game-related information, idle animations, or other information.

The wagering game may be implemented electronically. For example, in one embodiment, the table layout of FIG. 1 may be presented virtually to the user on an electronic gaming table, web page, stand-alone software, or in some other way to the user. The players can play the wagering game using a virtual interface. For example, the players may play the game by sitting at an electronic gaming table and interacting with an electronic game table interface. The electronic game can be configured with the rules of the game and automatically administer the game. Further, the game can be played over a network. A secure server can communicate with the players over the Internet or another network to administer the game.

Figure 2:
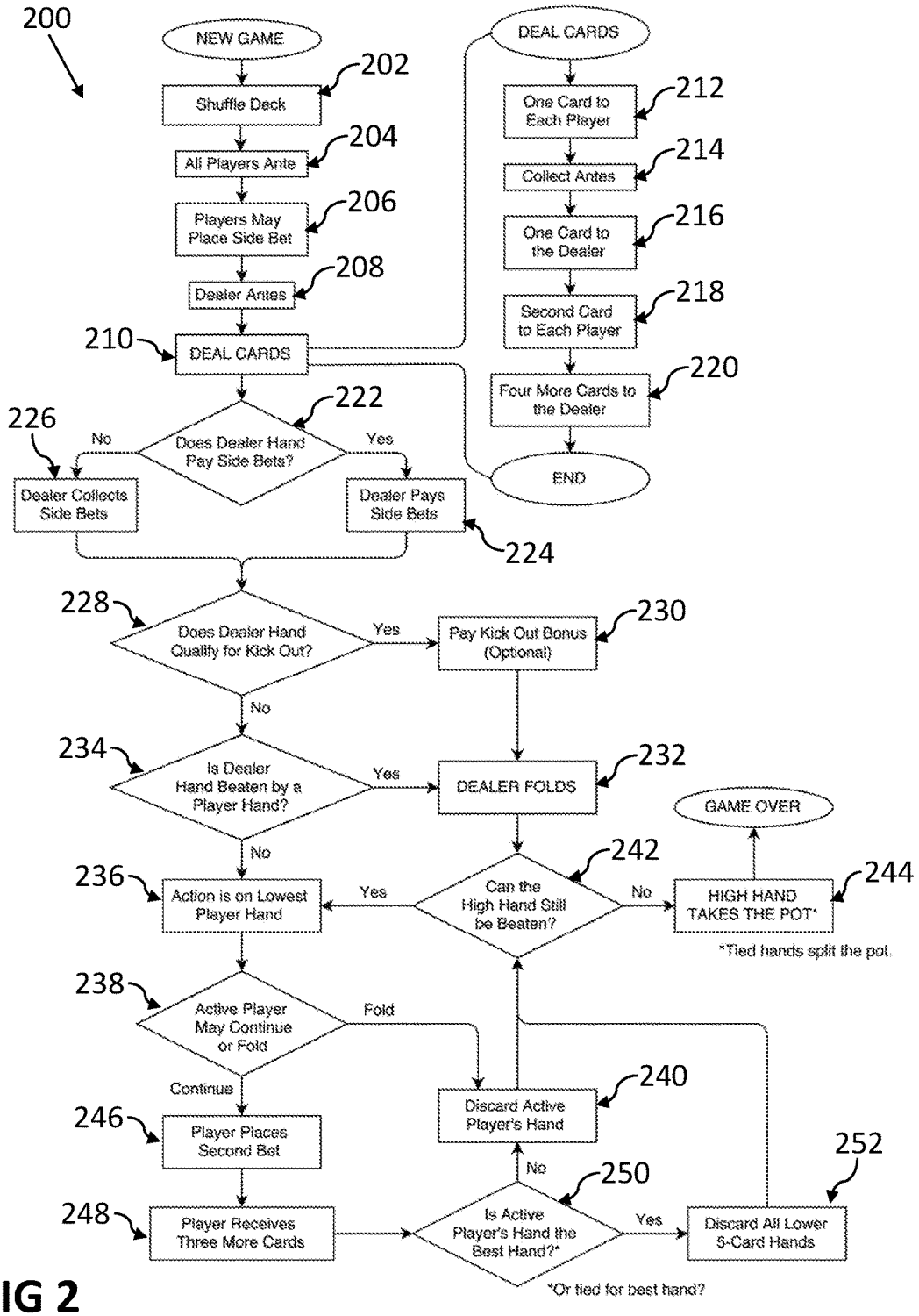
FIG. 2 shows a flowchart of the sequence of play for one embodiment.

Referring to FIG. 2, a flowchart of one embodiment of a poker casino game play method 200 utilizing a deck of playing cards is illustrated. A deck of playing cards are shuffled 202 and all players place an ante bet 204. The players may be encouraged to place their ante bet in the card area 22. Then, whether the game is electronically assisted or not, the dealer can move the player's ante bet from the card area 22 to the edge mark 26 in front of that player when dealing their first card. This procedure can help to keep the game organized and easier for security to observe. If the game is being played with a side bet, each of the players can also optionally place a side bet 206. In the current embodiment, the side bets are independent and are not limited by the size of the main bet. The dealer also antes 208 and then the dealer deals an initial partial face-up poker hand to each player and a complete poker hand to herself 210. These ante bets may each be referred to as a main bet. In the current embodiment, the players and dealer make the same size main bet, as dictated by the table limit.

After the dealer and each player have made their ante bet, each player and the dealer are dealt a face-up partial hand of cards, for example two cards. These cards may be dealt one at a time, similar to how Blackjack is dealt at a casino. Then, the dealer may be dealt additional cards to complete her poker hand, for example the dealer may be dealt three additional face-up cards creating a dealer hand of five face-up cards.

The dealing pattern can vary in different embodiments. In one embodiment, the five card poker hand to the dealer is dealt one card at a time. After dealing four cards to the dealer, the dealer can determine whether any fifth card is capable of causing the dealer's five card poker hand to meet or exceed a predetermined threshold poker hand ranking and qualify for a kick out. If a fifth card is capable of creating a kick out, the dealer can pause briefly before dealing the fifth card in order to increase player anticipation and excitement. One embodiment of a wind-up method includes, after dealing a number of cards insufficient to complete the dealer's poker hand, determining a single card is capable of causing the dealer's complete poker hand to meet or exceed the kick out predetermined poker hand rank threshold. In response to determining a card is capable of causing the dealer's complete poker hand to meet or exceed the kick out predetermined poker hand rank threshold, pausing before each further card is dealt to the dealer to complete the dealer's poker hand.

The game can be dealt in a variety of different ways. In one embodiment, cards can be dealt in an overlapping line, starting on the player's card area 22. This can facilitate the ability of the dealer to quickly move action around the table to the active player. Procedurally, in one embodiment, the dealer can clear any bets in the card area 22 into the pot as she deals the initial partial poker hands to the players, and leave the side bets until the whole deal is out. Then, the dealer can check the side bets and either clear them or pay them. Then, by the time the dealer deals the rest of the cards, there are no bets on the table except those in the pot.

In the current embodiment, the dealer deals one card to each player 212 collecting that player's ante bet 214 as she deals by moving that player's ante bet from that player's card area to the edge mark spot in front of the player, but in the pot area. Then, the dealer deals one card to herself 216. The dealer continues by dealing a second card to each player 218 and then four more cards to herself to complete the dealer poker hand 220.

If there are any side bets, the dealer determines whether the dealer hand pays out 222. If the dealer hand qualifies by meeting a certain threshold poker hand rank, the dealer pays out 224 on the side bet according to a predetermined pay table. If the dealer hand does not qualify because it does not meet any of the threshold poker hand ranks on the predetermined pay table, then the dealer collects the side bets 226 and places the chips in the dealer chip rack.

The next step is for the dealer to determine whether the dealer hand qualifies for a kick out by comparing the dealer poker hand to a predetermined poker hand rank threshold 228. If the dealer's poker hand meets or exceeds the predetermined poker hand rank threshold, it qualifies and folds the dealer hand 232. Optionally, in some embodiments, the dealer adds a bonus amount to the pot when the dealer's hand qualifies for a kick out 230. In one embodiment, the dealer adds chips to match the current amount in the pot, thereby doubling the pot, and folds his hand. In an alternative embodiment, if the dealer's hand qualifies, the game is over and all players immediately win their ante bet back along with a kickback based on a kickback paytable.

If the dealer's poker hand does not meet or exceed the predetermined poker hand rank threshold, a determination is made as to whether the complete dealer poker hand is beaten by any of the player's two card hands 234. For example, if a player has a pair and the dealer hand has a Jack high hand. If the dealer hand is beaten, then the dealer folds 232, the dealer checks to see if the high hand is still beatable 242, and if it is, action moves to the player with the lowest rank partial poker hand 236. If the high hand cannot be beaten, then the high hand takes the pot and the game is over 244. If the dealer's hand is not beaten by a player's partial poker hand, then action also moves to the player with the lowest rank partial poker hand 236. "Can be beaten" may include the potential value of any two-card hands, with cards yet to come. For simplicity, in some embodiments, any two-card hand may be considered viable even in cases where no remaining cards can actually improve it.

The active player is given an opportunity to fold or continue in the hand 238. If the player folds, the active player's poker hand is discarded 240 and a determination is made whether the high hand can still be beaten 242. If it can still be beaten, then action continues with the player that has the lowest partial poker hand 236. If it can't be beaten, then the player or dealer with the winning poker hand takes the pot and the game is over 244.

If the player chooses to continue she places an additional bet 246 and the dealer deals that player additional cards to complete that player's poker hand 248, in the current embodiment three additional cards. Once the player receives the additional cards, the dealer reviews the active player's hand to determine if it is the best poker hand at the table among the partial and complete poker hands at the table 250. If it is the best hand, all lower complete poker hands are discarded 252, while lower partial poker hands are left in place. If it is not the best hand, the active player's hand is discarded 240. If the high hand can still be beaten, then action moves to the next player with the next lowest partial poker hand 236. If the high hand cannot be beaten, the player or dealer with the high hand takes the pot and the game is over 244.

As discussed above, once all players have acted, the player or dealer with the highest poker hand wins the pot. All remaining cards are discarded and the game ends. In the current embodiment, multiple players with identically ranked poker hands divide the pot as evenly as possible, with any remainder going to the player who acted last.

Setup for the wagering game includes randomizing a deck of playing cards. In the current embodiment the deck of playing cards is a standard poker deck with 4 suits (clubs, spades, diamonds, and hearts) each having 13 ranks (A, K, Q, J, 10, 9, 8, 7, 6, 5, 4, 3, 2). However, the game can be played with a variant poker deck. For example, the game can be played with one, two, or more jokers. The jokers can be treated as normal wilds, or as "bugs," which can act only as Aces or to fill straights and flushes. The game can be played with other poker deck variations—for example fewer or additional suits, and/or a different number of ranks. In one embodiment, the game can be played with two or more poker decks. The kick out table can be adjusted based on any variant poker deck. For example, if jokers are used, the predetermined poker hand rank thresholds for the kick out qualification can be adjusted.

The game can be played with a variety of different predetermined poker game rule sets. In one embodiment, the predetermined poker game rules for determining the winner are the same poker game rules as Five Card Poker, which uses the same basic ranking of winning poker hands as most poker games: royal flush, straight flush, four of a kind, full house, flush, straight, three of a kind, two pair, one pair and high card(s) in hand. In alternate embodiments, a different set of predetermined poker game rules for determining the winner can be utilized. The kick out table can be adjusted based on the predetermined poker game rule set.

In one embodiment, the partial initial poker hand dealt to the players is two cards. In alternative embodiments the partial initial poker hand dealt to the player can be additional or fewer cards. Further, in one embodiment, players are dealt three additional cards when placing an additional wager to complete their poker hand. In alternative embodiments, the players may be dealt additional or fewer cards to complete their poker hand. Likewise, in one embodiment, the dealer is dealt a face-up poker hand of five cards, but in alternative embodiments may be dealt a hand of additional or fewer cards. The kick out table can be adjusted based on the number of cards dealt to the dealer and the players.

The size of the ante wager can vary. For example, the game can be played for a $5, $10, or $25 ante wager. At a $5 table, each ante wager is $5. In one alternative embodiment, only the players place an ante wager. The house advantage can be increased by eliminating a dealer ante. Further, the predetermined poker hand rank threshold or the amount of the kickback, if utilized, can be adjusted to compensate for the increase in house advantage. This can also increase excitement because the amount and the frequency of the kick out may be increased.

Without a kick out, the dealer has a built-in advantage because she only pays one bet for her hand, while the players must pay two bets to receive their complete poker hand. This advantage can be compensated by the kick out threshold or, if utilized, the kickback bonus amount. That is, the kick out table allows the odds of the game to be controlled. Further, by controlling the amount and frequency of the kick out, the house advantage and player excitement can be adjusted.

In one embodiment, if the dealer's hand qualifies for the kick out, the dealer folds and the rest of the players keep playing to compete for the pot. For example, with four players, the dealer's kick out qualification hand might be Two Pair, AA-22 or better, or with five players, the dealer's kick out qualification hand might be 3-of-a-kind Deuces or better. In this embodiment, if the dealer's hand qualifies for a kick out, the dealer folds, but does not add any kickback bonus to the pot.

The predetermined poker hand rank threshold for the kick out qualification can be varied based on one or more factors such as the number of players in the game and desired house advantage. Two exemplary kick out threshold tables are included below that show exemplary kick out thresholds for different player counts.

TABLE 1

KICK OUT THRESHOLD TABLE

| # of Players | Poker Hand Threshold |
|---|---|
| 7 | Straight or better |
| 6 | 3-of-a-kind Queens or better |
| 5 | 3-of-a-kind Deuces or better |
| 4 | Two Pair, Aces high or better |
| 3 | Two Pair, 10's high or better |
| 2 | Pair of Aces with a Queen or better |
| 1 | Pair of Kings with a Queen or better |

TABLE 2

KICK OUT THRESHOLD TABLE

| # of Players | Poker Hand Threshold |
|---|---|
| 7 | Straight or better |
| 6 | 3-of-a-kind Queens or better |
| 5 | 3-of-a-kind Deuces or better |
| 4 | Two Pair, Aces high or better |
| 3 | Two Pair, 10's high or better |
| 2 | Any Two Pair or better |
| 1 | Pair of Aces or better |

In another embodiment, if the dealer's hand qualifies for the kick out, the dealer folds and pays a kickback bonus amount to the pot before the rest of the players keep playing to compete for the pot. Depending on the kickback bonus amount, the kick out qualification thresholds might vary. For example, with four players, the dealer's kick out qualification hand might be Two Pair, QQ-22 or better, but with five players, the dealer's kick out qualification hand might be Two Pair KK-22 or better. In one embodiment, if the dealer's hand qualifies for a kick out, the dealer adds a kickback amount equal to the current amount of the pot, effectively doubling the amount of the pot. For example, in a seven player game with a $5 ante bet, if the dealer's hand qualifies, the pot with the kickback before any player action would be $80. That is, the dealer would match the $40 already in the pot (seven $5 player ante bets plus one $5 dealer ante bet) with $40 from the dealer chip rack.

In one alternative embodiment, instead of the dealer adding to the pot, folding, and allowing the hand to continue, each player wins their ante wager back plus an additional kickback award and the game is over. For example, if the ante wager is $5 and the kickback award pays 1:1, then if the dealer's hand qualifies each player collects their $5 ante wager along with a $5 kickback award and the game is over. In another alternative embodiment, instead of the dealer adding the kickback to the pot, each player is paid a fixed amount (i.e., 4× or 5× the ante bet) and then the hand continues with the dealer remaining in the hand. In yet another alternative embodiment, instead of the dealer adding the kickback to the pot, each player is paid a fixed amount (i.e., 1× or 2× the ante bet), the dealer folds, and then the hand continues with one of the players winning the pot. In yet another alternative embodiment, the dealer adds a larger kickback amount (i.e., a kickback sized to triple or quadruple the size of the pot), but the dealer stays in the hand instead of folding, and play continues until the dealer or one of the players wins the pot.

Because the payout of the kickback can change as the number of players in the game changes, the predetermined poker hand rank threshold for the kick out may be adjusted to compensate. For example, in one embodiment, the kick out threshold changes based on the number of players participating in the hand. In this embodiment, the dealer doubles the pot and folds if the dealer's poker hand qualifies for the kick out by meeting or exceeding the poker hand threshold for the kick out based on Table 3.

TABLE 3

KICK OUT THRESHOLD WITH KICKBACK TABLE

| # of Players | Poker Hand Threshold |
|---|---|
| 7 | Two pair, AA-TT or better |
| 6 | Two pair, AA-22 or better |
| 5 | Two pair, KK-22 or better |
| 4 | Two pair, QQ-22 or better |
| 3 | Two pair, TT-55 or better |
| 2 | Two pair, 88-22 or better |
| 1 | Two pair, 33-22 or better |

The kick out threshold tables shown in Tables 1-3 are just examples of kick out threshold tables. Examples of alternative kick out threshold tables are shown in Tables 4 and 5 below.

TABLE 4

KICK OUT THRESHOLD WITH KICKBACK TABLE

| # of Players | Poker Hand Threshold |
|---|---|
| 7 | Any Trips or better |
| 6 | Aces Up or better |
| 5 | Kings Up or better |
| 4 | Queens Up or better |
| 3 | Jacks Up or better |
| 2 | Eights Up or better |
| 1 | Any Two Pair or better |

TABLE 5

KICK OUT THRESHOLD WITH KICKBACK TABLE

| # of Players | Poker Hand Threshold |
|---|---|
| 7 | Any Trips or better |
| 6 | Any Trips or better |
| 5 | Aces up or better |
| 4 | Kings Up or better |
| 3 | Queens Up or better |
| 2 | Tens Up or better |
| 1 | Fives Up or better |

"Up" in poker parlance means two pair, so "Tens Up" is two pair with tens being the higher pair. As an example, a Tens Up threshold is equivalent to a TT-22 threshold and a Queens Up threshold is equivalent to a QQ-22 threshold. "Trips" means three of a kind. It is worth repeating that these are kick out threshold hands and that if the dealer's hand meets or exceeds the appropriate hand for the number of players, then the kick out is triggered. For example, a dealer hand of a straight, full house, flush, or four-of-a-kind would trigger the kick out on any of the example kick out threshold tables at any player count.

The predetermined poker hand rank thresholds in a kick out threshold table can be adjusted. Changing the kick out threshold changes the frequency of the kick out. A change in the kick out threshold can be accompanied by a change in the amount of the kickback, if utilized, in order to change the volatility of the game. For example, the kick out threshold can be lowered and the amount of the kickback lowered such that the kick out trigger occurs more often, but not as much money is added to the pot. Similarly, the kick out threshold can be increased and the amount of the kickback increased such that the kick out trigger occurs less often, but more money is added to the pot when it does. Of course, the amount of the kickback and the frequency of the kick out may also be adjusted independently.

One example of a kick out with double kickback table is shown in Table 6. Table 6 is essentially the same kick out threshold table as Table 3, except the poker hand thresholds are shifted one position. In addition, the amount of the kickback used in conjunction with the double kick out threshold table is increased. Specifically, the dealer adds an award equal to twice the size of the pot, effectively tripling the size of the pot, but the predetermined poker hand rank threshold for a given number of players is higher. A double kickback predetermined poker hand rank threshold can be referred to simply as a double kick out threshold. The double kick out threshold table is one exemplary kick out threshold table that can be used.

TABLE 6

KICK OUT WITH DOUBLE KICKBACK TABLE

| # of Players | Poker Hand Threshold |
|---|---|
| 7 | Any Trips or better |
| 6 | AA-TT or better |
| 5 | AA-22 or better |
| 4 | KK-22 or better |
| 3 | QQ-22 or better |
| 2 | TT-55 or better |
| 1 | 88-22 or better |

The game may include a super kickback. A super kickback is a larger kickback that triggers if the dealer's poker hand meets a more difficult super kickback predetermined poker hand rank threshold, such as four of a kind, straight flush, or royal flush. In one embodiment, in addition to adding the kickback amount to the pot, each player is separately paid a super kickback based on a predetermined poker hand rank threshold super kickback table. A super kickback predetermined poker hand rank threshold can be referred to simply as a super kick out threshold. One example of such a super kickback paytable is shown in Table 7. If the dealer's hand meets a super kickback predetermined poker hand rank threshold players win an award based on the ante bet—for example if the dealer's hand is a four of a kind and the ante bet is $5, then the dealer doubles the pot for the normal kickback, folds, and each player is awarded a $20 super kickback. The hand then continues until the pot with the normal kickback, if one is utilized, is awarded. This super kickback can be provided regardless of the number of players participating. In an alternative embodiment if the dealer's hand qualifies for a super kickback, the super kickback can be added instead of, or in addition to, the normal kickback to the pot.

TABLE 7

PREDETERMINED POKER HAND RANK THRESHOLD FOR SUPER KICKBACK

| Size of Award | Poker Hand Threshold |
|---|---|
| Players win 4:1 | Four of a Kind |
| Players win 10:1 | Straight Flush |
| Players win 25:1 | Royal Flush |

After determining whether the dealer's hand qualifies for a kick out and resolving the kickback, if one is being utilized, action moves to the players. The players take turns either folding or placing an additional wager to receive additional cards. By having the initial partial poker hands face-up, the player actions can be organized by the rank of the face-up initial partial poker hands. For example, action can begin with the player having the lowest ranked two card poker hand and proceed to the player with the next lowest ranked two card poker hand. Play can continue this way until each player has had an opportunity to act. Ties in player order can be differentiated by a predetermined suit ranking of the player's high card(s). One common convention for suit ranking is ascending alphabetical order: clubs ♣ (lowest ranked suit), diamonds ♦, hearts ♥, and spades ♠ (highest ranked suit). For example, using the ascending alphabetical order, a ten-high hand with a ten of clubs would be a lower ranked partial poker hand and therefore act before a ten-high hand with a ten of diamonds. This order of action allows players with worse partial initial hands to act before players with better partial initial poker hands.

Organizing the order of player action by rank of partial poker hand randomizes the player order in an equitable way and removes advantage that might be conveyed by a player's position at the table, even with respect to other players, which a dealer button mechanic would not accomplish. In other words, if the action always begins in seat 1, as in blackjack, when you are to the left of Player A, you always act after that player (unless there is a button, in which case you act before him once every round). In this game, the players act in a random order each time, so one player's skill or mistakes can't persistently affect a specific other player.

Organizing the order of player action by rank of partial poker hand also creates more opportunities for lead changes in the game because if a player with a worse starting hand improves his hand to a higher ranking than a player that had a better starting hand, then that player is now leading in the hand. Acting in the opposite order can be somewhat anti-climactic because if the player acting first has a better starting hand than a player acting later, when the player acting first with the better starting hand improves his hand, the lead in the hand does not change.

Organizing the order of player action by rank of partial poker hand also controls the flow of information available to the players. Generally, acting later in turn order is an advantage because the decision of whether to fold or place an additional bet can be based on additional information provided by players earlier in the turn order folding or taking additional face-up cards. Thus, ordering play based on starting hand is fair and random for all positions, not just for the player who acts first.

When it is a player's turn to act, that player may fold or make an additional wager to receive additional cards to complete their poker hand. If a player chooses to fold, the player withdraws from the game and the player's hand is discarded. In one embodiment, a losing player's cards may be mucked face down into a common discard pile. In one embodiment, if a player chooses to continue playing, the player makes another wager and is dealt three additional face-up cards. In one embodiment, the size of the play wager matches the size of the initial ante, e.g., $5.

The game can be dealt in a particular way to reduce confusion by tracking one winning poker hand and mucking non-winning hands as they are completed. Any face-up five card hand that is losing to the dealer or another player's existing five card hand or losing to another player's existing two card hand at the table, can be discarded immediately. A set of predetermined rules can be used to determine whether a hand is winning or losing. In this way, once the initial deal is complete, if the dealer's hand is beat by any of the players' partial poker hands, the dealer's hand can be discarded. After a player is dealt their additional face-up cards to complete her hand, if her hand is not the best hand, or loses to an existing two card hand, it can be discarded. In this way, there is at most only one five-card hand visible at any time, unless two five-card hands are being compared or there is a tie for high hand. For example, if the dealer and player both have a tied five-card hand, and one of the players is dealt a hand that beats those tied hands, then both of the lower tied hands can be discarded.

The game offers an opportunity for all players to root collectively against the dealer, and also a chance to compete and win against fellow players. If there is a kick out, then the dealer folds and adds a kickback (if one is being utilized), and the players compete for the pot. If there is no kick out, then the dealer is just another opponent.

There are a number of other variations on the game. For example, the game can also be played as a ring game without a "house" dealer, in which case all players begin with two cards and the rest of the action proceeds as described above.

Before the deal, players can make a side bet along with their ante bet. This side bet can be referred to as an insurance bet, or cover bet. The ante bet is constrained to the table limit (for example $5), but the cover bet can be any size, as dictated by the house limits. Like the odds bet in craps, the return to player percentage for this cover bet can be set as high as 100%, because it can be contingent on the ante bet—that is, it cannot be made by itself. The cover bet returns a value, paid by the house, based on the dealer's complete poker hand. This can be irrespective of the player's result on the ante bet, and is paid or collected immediately after the deal. For example, Table 8 shows one example pay table for the side bet.

TABLE 8

| SIDE BET PAYTABLE: COVER BET | |
|---|---|
| Size of Award | Dealer Hand Threshold |
| Player wins 1000:1 | Royal Flush |
| Players win 100:1 | Straight Flush |
| Players win 50:1 | Four of a Kind |
| Players win 25:1 | Full House |
| Players win 9:1 | Flush |
| Players win 6:1 | Straight |
| Players win 4:1 | Three of a Kind |
| Players win 2:1 | Two Pair |
| Players win 1:1 | Pair of Fives |

The payout for the side bet can be in addition to the player's bet. For example, if the player places a $5 ante and a $10 side bet, the dealer's hand is two pair, the player collects a total of $30:his $10 side bet and an additional $20 because of the 2:1 payout. Regardless of whether the side bet pays out, the player would have the opportunity to play out the rest of the hand, by either folding or receiving additional cards to complete her hand. The player can then go on to either win or lose the pot.

In some embodiments, a high hand bonus is built into the game. If a player's five-card hand is high enough, a High Hand Bonus is earned that is paid immediately. The High Hand Bonus schedule does not vary with the number of players. One example schedule of a High Hand Bonus is shown in Table 9 below. Other schedules can be created to adjust the house edge. The High Hand Bonus is paid whether the player's hand wins the main game or not. In one embodiment, no side bet is required to qualify for the High Hand Bonus because it is factored in as part of the main bet. If a player wins the pot with only two cards, he still receives three more cards automatically, to see if he wins a High Hand Bonus.

TABLE 9

| HIGH HAND BONUS TABLE (Pays when the Player Hand is sufficiently high) | |
|---|---|
| Player Hand | Pays |
| Royal Flush | 1000 |
| Straight Flush | 100 |
| 4 of a Kind | 25 |
| Full House | 10 |
| Flush | 5 |
| Straight | 2 |

Another type of side bet that may be allowed in some embodiments is a quickdraw bet. When a player makes his initial wager, he also has the option of making a side bet of any size (within limits set by the house) on whether his first two cards will beat the dealer's hand. This bet may be paid at a ratio, for example 5-to-1.

Several exemplary hands of one embodiment of the poker casino game play method are provided below.

In the first example, the dealer and each of the players place $5 ante wagers making the initial pot $20. In addition, Player 1 makes a $10 side bet and Player 3 makes a $20 side bet. These side bets are not in the pot. The dealer and the players are dealt the following cards:

TABLE 10

| Player 1 $5 Ante $10 Side Bet | Player 2 $5 Ante No Side Bet | Player 3 $5 Ante $20 Side Bet | Dealer $5 Ante |
|---|---|---|---|
| 10♠ 9♥ | 6♣ 4♠ | Q♦ J♦ | 2♥ 2♣ J♠ 2♥ 2♣ |

Player 1 and Player 3 made side bets, which are resolved. The side bet pay table shows that a dealer's four-of-a-kind pays 50:1 on any side bet. Accordingly, Player 1 is awarded $500 and Player 3 is awarded $1,000. If the dealer hand was a pair of fives or better, Players 1 and 3 would have won $10 and $20 respectively. If the dealer's hand was a pair of fours or worse, then the side bets would lose and the dealer would collect the side bets into the dealer chip rack.

For this game, the kick out threshold for 3 players is Two Pair, TT-22 or better. The dealer was dealt four-of-a-kind, which triggers the kick out because four-of-a-kind exceeds the predetermined poker hand rank threshold of Two Pair, TT-22 or better. If this game were being played with a standard kickback, the dealer would double the pot by adding $20 and folding. If the game was being played without a kickback, the dealer would just fold without adding any kickback bonus to the pot.

If the super kickback rules were in place, all three of the players would be awarded $20 for the super kickback because four-of-a-kind meets the super kick out threshold for a 4:1 payout. The super kickback payout is based on the ante, and, when the super kickback rules are in place, pays out regardless of whether a player places a side bet.

Once any kick out and super kickback are resolved, play continues, starting with Player 2 because she has the lowest hand with a six high. Player 2 chooses to pay an additional wager of $5 to receive three additional cards. In this example, Player 2 is dealt 6♠ 4♣ 4♥ making a full house. If the High Hand Bonus were in force, this player would immediately win 10:1, or $50, for her full house. Action then moves to Player 1 with a 10-high hand, who chooses to fold followed by Player 3 with a Q-high hand, who also chooses to fold. Player 2 wins the $45 pot.

In a second example, the dealer and each of the players place $5 ante wagers. The dealer and the players are dealt the following cards:

TABLE 11

| Player 1 $5 Ante $5 Side Bet | Player 2 $5 Ante No Side Bet | Player 3 $5 Ante $10 Side Bet | Dealer $5 Ante |
|---|---|---|---|
| 8♠ 4♥ | 3♣ 2♠ | Q♦ J♦ | 2♥ 8♣ J♠ 10♥ 9♣ |

The kick out threshold for 3 players in this example is any Two Pair, TT-22 or better. The dealer was dealt a Jack high poker hand, which does not trigger the kick out because a Jack high poker hand does not meet or exceed the ranking of Two Pair, TT-22 or better. The dealer's hand is not high enough for players to win their side bets, so those bets from Players 1 and 3 are lost and collected to the dealer's chip rack. Further, the threshold for a super kickback was also not met. Play continues with the players being given an opportunity to fold or place an additional wager to receive three additional cards to complete their poker hand.

Player 2 acts first because she has the lowest ranking poker hand with a 3 high. She chooses to fold. Player 1 acts next because she has the next lowest ranking poker hand with an 8 high. Player 1 places an additional $5 wager to receive an additional three cards.

TABLE 12

| Player 1<br>$5 Ante<br>$5 Side Bet (lost)<br>$5 Additional Bet | Player 2<br>$5 Ante<br>No Side Bet | Player 3<br>$5 Ante<br>$10 Side Bet (lost) | Dealer<br>$5 Ante |
|---|---|---|---|
| 8♠ 4♥ 8♣<br>4♠ 2♣ | 3♣ 2♠<br>(Folded) | Q♦ J♦ | 2♥ 8♣ J♠<br>10♥ 9♣<br>(Discarded) |

Player 1 is dealt 8♣ 4♠ 2♣ and now has the best hand with two pair, beating the dealer's Jack high. The dealer's hand is discarded at this point because it is losing to Player 1's hand. Action moves to Player 3, who is last to act because she had the highest ranking initial partial two card poker hand. Player 3 also places an additional $5 wager to receive an additional three cards.

TABLE 13

| Player 1<br>$5 Ante<br>$5 Side Bet (lost)<br>$5 Additional Bet | Player 2<br>$5 Ante<br>No Side Bet | Player 3<br>$5 Ante<br>$10 Side Bet (lost)<br>$5 Additional Bet | Dealer<br>$5 Ante |
|---|---|---|---|
| 8♠ 4♥ 8♣<br>4♠ 2♣<br>(Discarded) | 3♣ 2♠<br>(Folded) | Q♦ J♦ K♣<br>9♠ 10♥<br>(Winner) | 2♥ 8♣ J♠<br>10♥ 9♣<br>(Discarded) |

Player 3 is dealt K♣ 9♠ 10♥ making a straight. If the high hand bonus were in force, Player 3 would win 2:1, or $10, for her straight. Player 3 is awarded the pot because she has the high hand. The pot is $30, which includes Player 1's $5 ante, Player 1's $5 additional wager, Player 2's $5 ante, Player 3's $5 ante, Player 3's $5 additional wager, and the dealer's $5.

In a third example, a player is playing heads-up against the dealer. The player places a $5 ante and does not make a side bet. The dealer and the players are dealt the following cards:

TABLE 14

| Player 1<br>$5 Ante | Dealer<br>$5 Ante |
|---|---|
| 6♠ 6♣ | 10♣ 7♦ 6♥ 5♣ 2♣ |

The kick out threshold for heads-up is KKQ, a Pair of Kings with a Queen (or better). On the starting deal, Player 1 receives 6♠ 6♣ and the dealer receives a ten-high hand: 10♣ 7♦ 6♥ 5♣ 2♣. The dealer hand does not trigger a kick out but the dealer immediately folds because her hand is losing to an existing two-card hand. Player 1 takes the $10 pot with his pair of sixes. If the high hand bonus were in force, Player 1 would automatically receive 3 more cards upon winning the pot, to complete his 5-card hand and see if it qualifies for a high hand bonus.

In a fourth example, two players each place a $5 ante and do not make a side bet. The dealer and the players are dealt the following cards:

TABLE 15

| Player 1<br>$5 Ante | Player 2<br>$5 Ante | Dealer<br>$5 Ante |
|---|---|---|
| K♠ J♥ | K♣ J♦ | 2♥ 8♣ J♠ 10♥ 9♣ |

The kick out threshold for two players is AAQ, a pair of Aces with a Queen or better. Player 1 receives K♠ J♥, Player 2 receives K♣ J♦, and the dealer receives a Jack-high hand: 2♥ 8♣ J♠ 10♥ 9♣. The dealer immediately folds because her hand is losing to both existing two-card hands. There were no side bets, so no side bets are paid, and the kick out threshold is not met, so there is no kick out (the dealer folds because her hand was too low, not too high). Player 1 and Player 2 have the same rank of hands King-high with a Jack kicker. In this example, using ascending alphabetical order: ♣, ♦, ♥, ♠, Player 2 would act first because the King of clubs is a lower rank than the King of spades and therefore Player 2 has the lower ranked King high partial poker hand. Player 2 chooses to place an additional wager to receive three additional cards.

TABLE 16

| Player 1<br>$5 Ante | Player 2<br>$5 Ante<br>$5 Additional Bet | Dealer<br>$5 Ante |
|---|---|---|
| K♠ J♥ | K♣ J♦ 10♦<br>9♦ 8♦ | 2♥ 8♣ J♠ 10♥ 9♣<br>(discarded) |

Player 2 is dealt 10♦9♦8♦, which completes her hand. Action then moves to Player 1, who also chooses to place an additional bet to receive three additional cards.

TABLE 17

| Player 1<br>$5 Ante<br>$5 Additional Bet | Player 2<br>$5 Ante<br>$5 Additional Bet | Dealer<br>$5 Ante |
|---|---|---|
| K♠ J♥ 10♠<br>9♠ 8♠<br>(Tied - Split Pot) | K♣ J♦ 10♦<br>9♦ 8♦<br>(Tied - Split Pot) | 2♥ 8♣ J♠<br>10♥ 9♣<br>(discarded) |

Player 1 is dealt 10♠ 9♠ 8♠, which completes her hand. In one embodiment, the players split the $25 pot because they have tied. Both players have a King-high hand with all of the same rank kicker cards. The predetermined suit ranking is only used to break turn order ties; it is not used to break a tie for who wins the hand. Instead, tied players split the pot. If Player 1 had instead been dealt 10♠ 9♠ Q♠, then Player 1 would have won the entire pot because the Queen kicker is higher than Player 2's Jack kicker.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A poker casino game play method utilizing a deck of playing cards, the method comprising:

receiving an ante wager from one or more players to participate in the poker casino game;

placing a dealer ante wager;

dealing, face-up, a two card poker hand to each player;

dealing, face-up, a five card poker hand to a dealer;

collecting the ante wager from the one or more players into a pot area;

in response to the dealer's five card poker hand qualifying for a kick out by meeting or exceeding a kick out predetermined poker hand rank threshold the dealer, folding the dealer's five card poker hand and continuing the game to determine a winner among the one or more players;

allowing each player to become an active player, in order from lowest to highest ranking of respective two card poker hand, to fold or place an additional wager to remain in the game;

in response to a player placing an additional wager, dealing, face-up, three additional cards to that player to complete that player's five card poker hand;

collecting any additional wagers from the one or more players into the pot area; and if the dealer's five card poker hand does not meet or exceed the predetermined poker rank threshold and is not folded, determining whether the dealer's five card poker hand is beaten by the active player's five card poker hand, if the dealer's five card poker hand is beaten by the active player's five card poker hand, then the dealer folding and action moving to the lowest ranked remaining two card poker hand, if the active player's five card poker hand is beaten by the dealer's five card poker hand, then folding the active player's five card poker hand and action moving to the lowest ranked remaining two card poker hand;

if the dealer's five card poker hand is folded, determining whether the active player's five card poker hand is beaten by another player's previously completed five card poker hand, and if the other player's previously completed five card poker hand is beaten by the active player's five card poker hand, folding the other player's previously completed five card poker hand and action moving to the lowest remaining two card poker hand, if the active player's five card poker hand is beaten by the other player's previously completed five card poker hand, then folding the active player's five card poker hand and action moving to the lowest ranked remaining two card poker hand;

determining a winning hand based on predetermined poker game rules and awarding any wagers in the pot area to the player or dealer with the highest ranked remaining five card poker hand.

2. A poker casino game play method of claim 1 wherein the predetermined poker hand rank threshold varies depending on the number of players participating in the poker casino game.

3. A poker casino game play method of claim 1 including in response to the dealer's five card poker hand qualifying for a kick out by meeting or exceeding a kick out predetermined poker hand rank threshold, adding a kickback bonus amount to the pot.

4. The poker casino game play method of claim 3 wherein the amount of the kickback bonus amount depends on the strength of the dealer's five card poker hand.

5. A poker casino game play method of claim 3 wherein adding the kickback bonus to the pot area includes determining the total wager amount in the pot and adding that amount to the pot from a dealer chip rack.

6. A poker casino game play method of claim 1 including immediately discarding any five card poker hand losing to the dealer's five card poker hand, any other player's five card poker hand, or any other player's two card poker hand.

7. A poker casino game play method of claim 1 including a side bet that pays based on the strength of the dealer's complete poker hand according to a side bet paytable irrespective of whether the dealer's hand qualifies for the kick out and irrespective of whether the player has a winning hand.

8. A poker casino game play method of claim 1 including sensing a number of ante wagers, selecting one of a plurality of kick out predetermined poker hand rank thresholds based on the number of ante wagers sensed, and displaying the selected kick out predetermined poker hand rank threshold.

9. A poker casino game play method of claim 8 including reading the dealer hand with a dealer hand reader and automatically indicating the dealer hand qualifies for the kickback by meeting or exceeding the selected kickback predetermined poker hand rank threshold.

10. A poker casino game play method, the method comprising:

accepting one or more ante wagers from one or more players to participate in the poker casino game;

dealing, face-up, a partial poker hand from a set of randomly ordered cards to each player and the dealer;

dealing, face-up, additional cards from the set of randomly ordered cards to complete the dealer poker hand;

comparing the poker hand of the dealer to a kick out predetermined poker hand rank threshold to determine if the dealer's poker hand qualifies for a kick out and in response to the dealer's hand qualifying, the dealer folding the dealer's poker hand and continuing the game to determine a winner among the one or more players;

the dealer comparing each player's remaining partial poker hand to determine relative ranking based on predetermined poker game rules and action moving to the lowest ranked remaining partial poker hand;

accepting from each player, in order from lowest to highest relative ranking of the partial poker hands, an additional wager to remain in the game or an indication of folding, wherein each player making the additional wager becomes an active player and is dealt a second portion of a poker hand to complete that player's poker hand;

if the dealer's complete poker hand does not meet or exceed the predetermined poker hand rank threshold and is not folded, determining whether the dealer's complete poker hand is beaten by the active player's complete poker hand, if the dealer's complete poker hand is beaten by the active player's complete poker hand, then the dealer folding, if the active player's complete poker hand is beaten by the dealer's complete poker hand, then folding the active player's complete poker hand;

if the dealer's complete poker hand is folded, determining whether the active player's complete poker hand is beaten by another player's previously completed poker hand, and if the other player's previously completed poker hand is beaten by the active player's complete poker hand, folding the other player's previously completed poker hand, if the active player's complete poker hand is beaten by the other player's previously completed poker hand, then folding the active player's complete poker hand;

determining a winner of the poker casino game based on predetermined poker game rules and awarding any ante wagers, any additional wagers, and any kickback to the winner.

11. A poker casino game play method of claim 10 wherein the predetermined poker hand rank threshold varies depending on the number of players participating in the poker casino game.

12. A poker casino game play method of claim 10 wherein in response to the dealer's hand qualifying, adding a kickback to the pot area.

13. A poker casino game play method of claim 12 wherein the amount of the kickback depends on the strength of the dealer's complete poker hand.

14. A poker casino game play method of claim 12 wherein adding the kickback includes determining the total ante wager amount in the pot and adding that amount to the pot from a dealer chip rack.

15. A poker casino game play method of claim 10 including immediately discarding any complete poker hand losing to the dealer's complete card poker hand, any other player's complete poker hand, or any other player's partial poker hand.

16. A poker casino game play method of claim 10 including the dealer placing an ante wager.

17. A poker casino game play method of claim 10 including a side bet that pays based on the strength of the dealer's complete poker hand according to a side bet paytable irrespective of whether the dealer's hand qualifies for the kickback.

18. A poker casino game play method of claim 10 including sensing a number of ante wagers, selecting one of a plurality of kickback predetermined poker hand rank thresholds based on the number of ante wagers sensed, and displaying the selected kick out predetermined poker hand rank threshold.

19. A poker casino game play method of claim 18 including reading the dealer hand with a dealer hand reader and automatically indicating the dealer hand qualifies for the kick out by meeting or exceeding the selected kickback predetermined poker hand rank threshold.

* * * * *